United States Patent [19]

Nakako et al.

[11] 4,314,898

[45] Feb. 9, 1982

[54] PROCESS FOR REFORMING COAL

[75] Inventors: Yukio Nakako, Takarazuka; Toshio Ohzawa, Kobe; Shizuo Yokota, Nishinomiya; Masaaki Tamura, Kobe, all of Japan

[73] Assignee: Kobe Steel, Ltd., Kobe, Japan

[21] Appl. No.: 144,883

[22] Filed: Apr. 29, 1980

[30] Foreign Application Priority Data

May 1, 1979 [JP] Japan ..... 54-054516

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,508,203 | 4/1970 | Nelson | 208/8 LE |
| 3,594,304 | 7/1971 | Seitzer et al. | 208/8 LE |
| 3,645,885 | 2/1972 | Harris et al. | 208/8 LE |
| 3,892,654 | 7/1975 | Wright et al. | 208/8 LE |
| 4,094,765 | 6/1978 | Bearden, Jr. et al. | 208/8 LE |

FOREIGN PATENT DOCUMENTS

| | | | |
|---|---|---|---|
| 2548946 | 5/1976 | Fed. Rep. of Germany | 208/8 LE |
| 50-67801 | of 1975 | Japan . | |
| 51-27894 | of 1976 | Japan . | |

*Primary Examiner*—Delbert E. Gantz
*Assistant Examiner*—William G. Wright
*Attorney, Agent, or Firm*—Oblon, Fisher, Spivak, McClelland & Maier

[57] ABSTRACT

Improvements in a process for reforming coal by subjecting a mixed slurry containing a hydrocarbon solvent and coal fines to hydrogenation reaction under high temperature and pressure conditions, gas-liquid separation, and distillation to obtain a solvent-refined coal, the improvements comprising: maintaining the reaction temperature and total reaction pressure within a hydrogenation reactor at 400° to 500° C. and 50 to 200 atms., and controlling the residence time distribution of reactants, excepting gaseous reactants, in the hydrogenation reaction zone to have an average residence time longer than 17 minutes, and to keep the quantity of the reactants which have a residence time shorter than 10 minutes in a proportion less than 20% by weight of the reactants.

3 Claims, 5 Drawing Figures

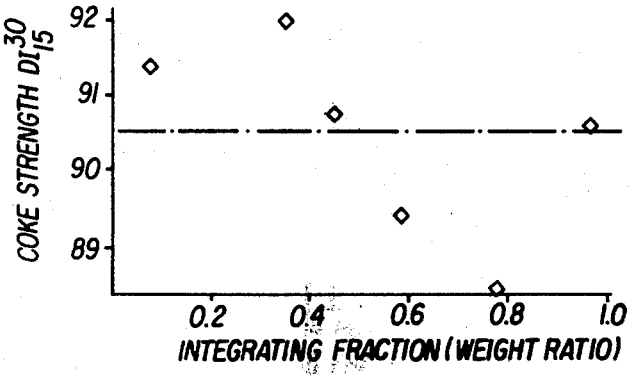
FIG. 3(III)

PROCESS FOR REFORMING COAL

BACKGROUND OF THE INVENTION

This invention relates to a process for reforming coal, and more particularly to a method for reforming coal into a form useful for the production of a metallurgical carbonaceous material and/or a liquid product (a liquid fuel, or chemical raw materials) by controlling reaction factors including the residence time distribution of reactants in a reaction zone, except those in gaseous phase, in a predetermined reaction temperature range and under a total reaction pressure, in the "hydrogenation process" in which a slurry mixture containing a low grade coal such as brown coal and a hydrocarbon base solvent is subjected to hydogenation reaction under high temperature and pressure conditions.

To cope with the scarcity and high price in recent years of heavy coking coal, a raw material of coke which is used in iron production, many attempts have thus far been made to produce coke of increased strength from low-grade coals such as brown coal, peat, lignite, some bituminous coal and the like, by the so-called coal liquefaction technology (involving the hydrogenation reaction either in one step or in two steps), which produces a liquid product from coals, producing a solvent-refined coal by hydrogenation reaction of low-grade coals and blending it into a raw material to be used for coke production. In this connection, Japanese Laid-Open Patent Specification Nos. 67801/75 and 27894/76 disclose related processes: the former is directed to a process consisting of hydrogenating a non-coking or coking coal with a hydrocarbon solvent in a pressurized hydrogen atmosphere, separating solid fractions, and blending desulfurized and deashed, highly flowable products having a melting point of 100° C. to 350° C. into the raw coal to be coked; and the latter is directed to a process consisting of bringing an oxygen-rich solid carbonaceous fossil fuel, which is unsuitable for coking, into contact with a solvent and hydrogen for deoxygenation under pressurized and heated conditions, removing the solvent and volatile components from the resulting mixture by distillation, and recovering the residual mixture which can be used as a blending material for coke making. The latter process is especially advantageous since it dispenses with the deashing step which has been essential in the conventional coal liquefaction technology.

It is also known in the art to obtain a liquid product by further deashing and secondarily hydrogenating the solvent refined coal which is obtained by the above-mentioned process.

However, in the prior art including the above-mentioned processes, the hydrogenation step itself still depends on the conventional coal liquefaction technology, leaving many problems unsolved in obtaining carbonaceous products of a quality suitable for use as a metallurgical carbonaceous material, including coke for iron production. More particularly, when hydrogenating low-grade coals such as brown coal, peat, lignite, some bituminous coals and the like to obtain coke for steel production, the most important technical problem is how to improve the strength of coke of the ultimate product. This problem was not considered in the conventional coal liquefaction technology, and therefore the relation between the conditions of the hydrogenation reaction and the quality of the solvent refined coal as a metallurgical carbonaceous material has been unknown to date. In other words, there have not yet been developed processes which are capable of producing solvent refined coal of commercially satisfactory quality in an assured manner.

On the other hand, when a solvent-refined coal which is an intermediate product in the above-mentioned conventional processes is further subjected to secondary hydrogenation after separation by reduced pressure distillation for the purpose of obtaining a liquid product, the so-called coking trouble is often experienced at the bottom of the distillation tower due to free radicals or other unstable substances which remain in large amounts in the intermediate product depending upon the conditions of the primary hydrogenation. In addition, where such unstable solvent refined coal is subjected to secondary hydrogenation, difficulties are also encountered in that the increase in viscosity of the reaction mixture makes the deashing step troublesome, and said free radicals or other unstable substances invite deterioration of catalyst in the succeeding hydrogenation step due to coke deposition on the hydrogenation catalyst. However, no clarification has ever been made with regard to the relation between the reaction conditions of the primary hydrogenation step and the content of unstable substances in the solvent refined coal, and there has been proposed no method effective for reducing the content of the unstable substances.

SUMMARY OF THE INVENTION

With the foregoing in view, the present inventors have conducted extensive studies on the hydrogenation reaction conditions and accomplished the present invention on the basis of findings that, among various conditions, there is a strong correlation between the residence time distribution of reactants in the primary hydrogenation reaction zone in a particular temperature range under a total reaction pressure, and the quality of the resulting solvent refined coal, and that solvent refined coal of a quality suitable for a metallurgical carbonaceous material or for an intermediate material of the liquid product can be obtained by suitably controlling the residence time distribution.

More particularly, the present invention aims to provide improvements in a process for reforming coal by subjecting a mixed slurry containing a hydrocarbon solvent and coal fines to primary hydrogenation reaction under high temperature and pressure conditions, gas-liquid separation and distillation to obtain a solvent refined coal (reformed coal), the improvements comprising: maintaining the reaction temperature and total reaction pressure in the reactor at 400° C. to 500° C. and 50 to 200 atms., and controlling the residence time distribution of reactants, excepting gaseous reactants in the primary hydrogenation reaction zone to have an average residence time longer than 17 minutes, and to keep the quantity of the reactants which have a residence time shorter than 10 minutes in a proportion less than 20% by weight of the reactants.

The present invention employs low-grade coals such as brown coal, peat, lignite, some of bituminous coals and the like which have thus far been regarded as being unsuitable for the production of metallurgical coke. The solvent-refined coal which is recovered by gas-liquid separation of the reaction mixture resulting from the hydrogenation reaction can be mixed into coal which is to be used as a starting material for the production of metallurgical coke. In such a case, it is possible to obtain coke of high quality even when strongly coking coal is used in an extremely reduced mixing ratio. The present invention also gives satisfactory results even when combined with the so-called briquette-blend coke production or formed coke production process.

Moreover, in a case where the solvent-refined coal is obtained as an intermediate material in the production of a liquid product, it contributes to eliminate the coking trouble in the step of reduced pressure distillation prior to the secondary hydrogenation and to lower the viscosity of the reaction product in the deashing step thereby facilitating the deashing operation. Further, it has the effect of lessening the catalyst deterioration due to coke deposition in the succeeding secondary hydrogenation step.

The above and other objects, features and advantages of the invention will become apparent from the following description and appended claims, taken in conjunction with the accompanying drawings.

PARTICULAR DESCRIPTION OF THE INVENTION

Figure 1:
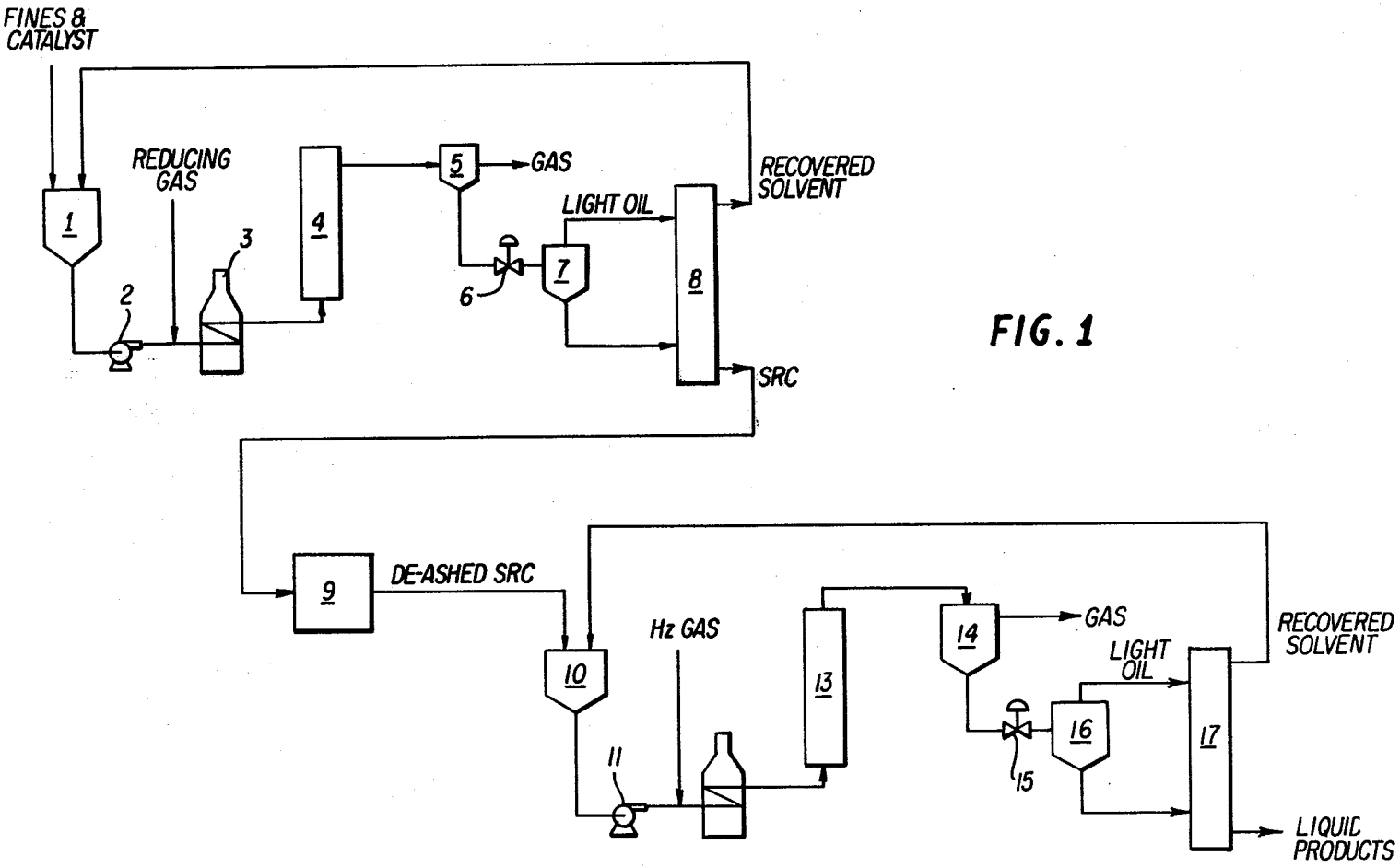
FIG. 1 is a flowsheet of a coal reforming system incorporating the present invention.

A reaction system for carrying out the present invention includes the steps, for example, as shown in the flowsheet of FIG. 1, arranging the respective steps as in the conventional coal liquefaction processes. More particularly, raw material coal fines are mixed with a hydrocarbon-base solvent in a slurry tank 1 and, if necessary, added with a catalyst to prepare a slurry of suitable concentration and viscosity. Before or after (preferably before) the slurry is preheated in a first preheater 3 through a slurry pump 2, it is admixed with a reducing gas (e.g., $H_2$ gas or a CO-steam mixture gas) and then introduced into a first hydrogenation reactor 4 to undergo the primary hydrogenation reaction therein. The primary hydrogenation reaction is effected at a temperature of 400° to 500° C. under a total pressure of 50 to 200 atms. In the reactor 4, the slurry flow is confronted by back mixing flows and caused to have a particular residence time distribution which gives adverse effects on the quality of the solvent-refined coal to be produced. The fluidity of the back mixing flows, which affect the residence time distribution, changes depending upon various factors such as the shape and capacity of the reactor, feeding rate of the slurry and the like. The distribution of the residence time can be measured by using a radioisotope as a tracer, introducing pulses of the tracer from the inlet of the reactor while recording the amounts of recovered tracer at the outlet of the reactor in relation to time on stream.

The effluent from the first hydrogenation reactor 4 is fed to a first gas-liquid separator 5 to separate the formed gases and residual reducing gas. Upon pressure reduction through a reduced-pressure flash valve 6, a change in phase occurs to the mixture to yield solid-, liquid- and vapor phases. Light oils forming the vapor phase are stripped by a second gas-liquid separator 7, and the resulting mixture which consists of heavy oils and solvent-refined coal is subjected to fractional distillation through a first distillation tower 8, for example, under reduced pressure of 40 to 150 mmHg and at temperatures of 280° to 350° C. (the hydrocarbon oils, i.e., heavy oils separated in the distillation tower 8 are recirculated to the slurry tank 1 to serve as a solvent). Thus, the reformed coal (solvent-refined coal) is now collected from the distillation tower 8. As shown in the Examples which appear hereinafter, the solvent-refined coal thus obtained can satisfactorily serve as a raw material for the production of coke, assuring a high quality with a drum index value $DI_{50}^{30}$ of higher than 90.5, as measured in accordance with the "Coke Strength Testing Method (JIS K-2151-6)", when used in the form of a blend with a heavy coking coal or a soft coking coal.

In the case where the solvent-refined coal is used as an intermediate material in the production of a liquid product, it is deashed in a deasher 9 and the deashed solvent-refined coal is mixed with a hydrocarbon solvent in a mixing vessel 10 to form a mixture of suitable concentration and viscosity. Before or after (preferably before) the mixture is preheated in a second preheater 12 through a feed pump 11, it is admixed with $H_2$ gas and fed to a second hydrogenation reactor 13 to undergo the secondary hydrogenation reaction in the presence of a hydrogenation catalyst (e.g., a Ni-Mo/$Al_2O_3$ or Co-Mo/$Al_2O_3$ catalyst) and under high temperature and pressure conditions.

The effluent from the second hydrogenation reactor 13 is fed to a third gas-liquid separator 14 to separate the formed gases and residual $H_2$ gas. Upon pressure reduction by a reduced-pressure flash valve 15, the mixture undergoes a change in phase and becomes discrete liquid- and vapor-phases. The light oils which constitute the vapor phase are separated by a fourth gas-liquid separator 16, and the resulting mixture which consists of the liquid product and heavy oils is subjected to fractional distillation in a second distillation tower 17, for example, under a pressure of 100 mmHg to 1 atm. and at a temperature below 300° C. (the hydrocarbon oil which is separated in the second distillation tower 17 in an amount equivalent to that of the heavy oil used in the mixing vessel 10 is recirculated to the mixing vessel to serve as a solvent). Thus, the liquid product is now collected from the second distillation tower 17.

The slurry which serves for the purpose of the invention can be prepared in an ordinary manner and by known procedures. For instance, the raw coal material is pulverized to have a particle size smaller than 100 mesh, preferably smaller than 200 mesh, and may consists of any of low-grade coals such as brown coal, lignite, peat, and some bituminous coals, as mentioned hereinbefore.

The hydrocarbon solvent to be used for the preparation of the slurry for the primary or secondary hydrogenation reaction is a hydrocarbon oil having a boiling point higher than 150° C. As shown in FIG. 1, the oil fraction separated in the distillation tower of the hydrogenation reaction system is recirculated for reuse. The concentration of raw coal fines in the feed slurry is normally adjusted in the range of 25 to 50 wt%.

If desired, the slurry mixture for the primary hydrogenation reaction may be admixed with an iron catalyst (e.g., ferrous oxide, ferric oxide, pure iron etc.), an iron-sulfur catalyst, an iron compound-sulfur catalyst or the like. The additive amount of the catalyst is normally 0.5 to 5 wt% (in terms of Fe) based on moisture- and ash-free coal.

The reaction temperature for the slurry thus prepared is adjusted to a level of 400 to 500° C.

The reducing gas for the primary and secondary hydrogenation reactions is added to the slurry by an ordinary method, preferably before entering the preheaters. The additive amount of the reducing gas for the primary and secondary hydrogenation reactions is normally 4 to 10 wt% in terms of hydrogen based on moisture- and ash-free coal.

The slurry which is added with the reducing gas is fed to the first hydrogenation reactor so that the residence time of the reactants in the reaction zone (except those in the gaseous phase) is distributed as mentioned hereinbefore. The reactor for use in the present invention may be of a continuous stirrer vessel type or a flow-through tube type. The flow rates of the slurry and the reducing gas are determined depending upon the capacity, shape and type of the reactor.

The desired product is separated or collected by an ordinary method from the reaction mixture which flows out of the reactor, i.e., by gas-liquid separation, distillation or the like.

The invention is illustrated more particularly by the following Example.

EXAMPLE

[I] Production of solvent-refined coal by hydrogenation reaction

Coal was reformed by a reaction system as shown in FIG. 1. A slurry was prepared in the slurry tank 1 by mixing pulverized Australian brown coal, an iron catalyst and a hydrocarbon oil which was circulated from the first distillation tower 8. The prepared slurry mixture was fed to the first preheater 3 by the slurry pump 2, adding $H_2$ gas to the slurry upstream of the first preheater 3. The preheated mixture of the slurry and $H_2$ gas was subjected to primary hydrogenation reaction in the first reactor 4 which was maintained at a temperature of 400° to 440° C. and a total pressure of 150 atms.

The reaction mixture (including the gaseous-phase components) which had undergone the hydrogenation reaction was allowed to flow out from the top of the reactor and led to the first gas-liquid separator 5 to separate the gases produced by the reaction and residual $H_2$ gas. After flashing at the reducedpressure valve 6, the mixture was fed to the second gas-liquid separator 7, taking out the light oil components of the mixture from the top of the separator while extracting the remaining mixture of heavy oils and solvent-refined coal through the bottom of the separator 7 for fractional distillation in the first distillation tower 8. By this fractionation, solvent-refined coal was recovered from the distillation tower. The hydrocarbon oil separated in the distillation tower was pumped to the slurry tank 1 and used again as a solvent for preparing the slurry.

In carrying out the above-described operations, the residence time distribution of the reactants in the first hydrogenation reactor was varied by changing the arrangement or shape of the first hydrogenation reactor 4 and feed rates of the slurry and hydrogen gas.

Table 1 below shows the shape and arrangement of the reactors used for the primary hydrogenation reaction, and the feed rates of the slurry and hydrogen gas.

TABLE 1

Shape and arrangement of first hydrogenation reactor

| | Shape/Size | Number/ Arrangement of reactors | Feed Rate of Slurry (Superficial Velocity m/hr) | Feed Rate of Hydrogen Gas (Superficial Velocity m/hr) |
|---|---|---|---|---|
| A. | 58 mm (diam.) × 4 m (length) | One | 14 | 44 |
| B. | 58 mm (diam.) × 4 m (length) | Two (series) | 14 | 44 |
| C. | 58 mm (diam.) × 4 m (length) | Three (series) | 14 | 44 |
| D. | 175 mm (diam.) × 1 m (length) | One | 1.8 | 5.5 |
| E. | 175 mm (diam.) × 3 m (length) | One | 2.6 | 6.5 |
| F. | 175 mm (diam.) × 1 m (length) | One | 14 | 44 |

Figure 2:
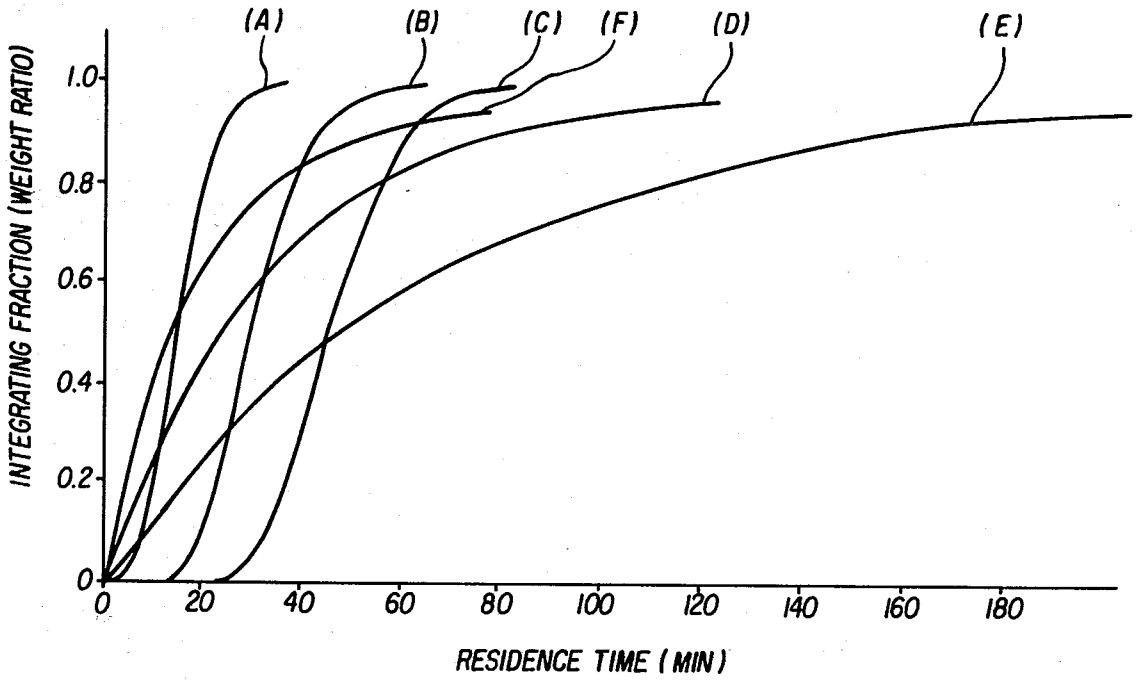
FIG. 2 is a graphic representation of residence time distribution of reactants in the primary hydrogenation reaction zone.

The residence time distributions of the solvent-refined coals obtained by the operations of Table 1 are shown in FIG. 2. In this figure, the curves A to F correspond to the operating conditions A to F of Table 1, and are plotted on an abscissa representing the residence time (minutes) of the reactants in the reaction zone, except those in the gaseous phase, and an ordinate representing the proportion by weight (integrating fraction) of the reactants having a residence time shorter than the residence time t on the abscissa based on the reactants. The average residence time of the reactants in each of the operations A to F was: A=17 minutes; B=34.3 minutes; C=51.6 minutes; D=34.2 minutes; E=69.4 minutes; and F=17.0 minutes.

[II] Production of coke and quality rating

The solvent-refined coals obtained in operations A to F with the residence time distributions in (I) above were used for the production of coke, and the strength of the resulting cokes was rated in terms of drum index value $DI_{15}^{30}$ (JIS K-2151-6).

Coke was also produced by the use of a base blending of Table 2 below. In this base blending, the proportion of medium-volatile coking coal from U.S.A. was reduced to 5% and the balance of 10% was substituted by the solvent-refined coal. The coke obtained from the base blending showed a $DI_{15}^{30}$ value of 89.

TABLE 2

Base blending for coke production (wt %)

| Coals | Blending ratio |
|---|---|
| Low-volatile heavy coking coal produced in U.S.A | 5 |
| Medium-volatile heavy coking coal produced in U.S.A | 15 |
| Heavy coking coal produced in Canada | 10 |
| Medium heavy coking coal produced in Australia | 40 |
| Soft coking coal produced in Australia | 20 |
| Coal produced in Japan | 10 |
| Total | 100 |

The $DI_{15}^{30}$ values of thus produced cokes are shown in Table 3 below.

TABLE 3

$DI_{15}^{30}$ values of cokes

| Solvent-refined coal | $DI_{15}^{30}$ |
|---|---|
| A (Average residence time : 17.1 min.) | 90.6 |
| B (Average residence time : 34.3 min.) | 90.8 |
| C (Average residence time : 51.6 min.) | 91.4 |
| D (Average residence time : 34.2 min.) | 89.4 |
| E (Average residence time : 69.4 min.) | 92.0 |

TABLE 3-continued

| $DI_{15}^{30}$ values of cokes | |
|---|---|
| Solvent-refined coal | $DI_{15}^{30}$ |
| F (Average residence time : 17.1 min.) | 88.5 |
| Base blending | 89.0 |

Figure 3I:
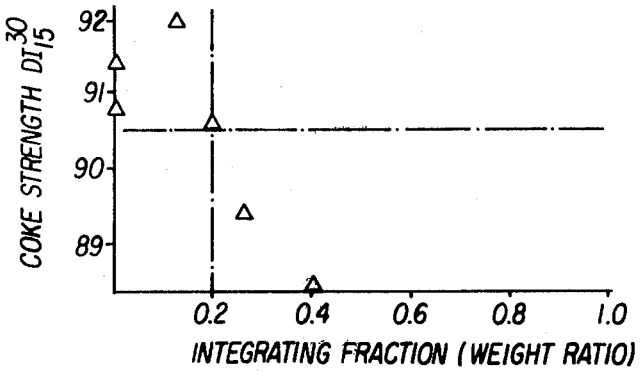
FIGS. 3 (I) to 3 (III) are graphic representations of the relation between the residence time distribution and coke strength of the reaction product (solvent-refined coal).
Figure 3:
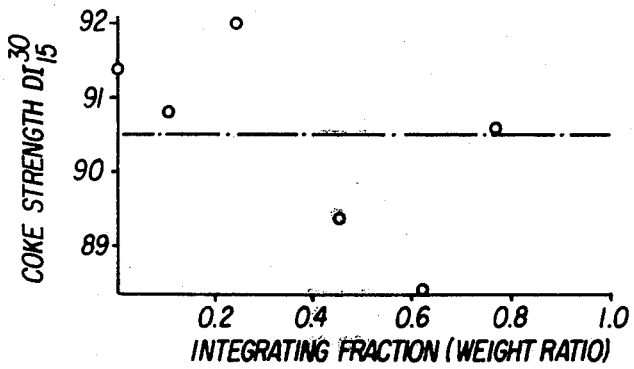

The graphs of FIG. 3 show the relationships between the residence time distribution of the solvent-refined coals and the strength of resulting cokes, in which the abscissa represents the weight ratio (integration fraction) of the reactants having a residence time shorter than the parameter residence time $t_0$ and the ordinate represents the $DI_{15}^{30}$ values of the cokes blended with the solvent-refined coal as mentioned hereinbefore. In FIG. 3, $t_0=10$ minutes in graph (I), $t_0=20$ minutes in graph (II), and $t_0=30$ minutes in graph (III). Upon studying the relation between the integration fraction and the strength of coke on basis of the data of graphs (I) to (III), it is evident that in graph (I) of $T_0=10$ minutes the coke strength $DI_{15}^{30}$ is in all cases higher than 90.5 with an integration fraction greater than 0.2 (20 wt%) and is invariably smaller than 90.5 with an integration fraction greater than 0.2 (20 wt%), showing a correlation between the integration fraction and the coke strength. In contrast, such correlation is not recognized in graphs (II) and (III) where $t_0=20$ minutes and $t_0=30$ minutes, respectively. This indicates that, in improving the quality of reformed coal to be used as a metallurgical carbonaceous material, the ratio by weight of reactants (integration fraction) having a residence time shorter than 10 minutes can be used as an index. In view of the fact that the coke to be used for the steel production is normally required to have a strength $DI_{15}^{30}$ higher than 90.5, it is evident from graph (I) that the ratio of reactants having a residence time shorter than 10 minutes should be less than 0.2 in integration fraction or less than 20% by weight.

Further, upon comparing the solvent-refined coals where the content of reactants having a residence time shorter than 10 minutes is less than 20% by weight, it is seen that the $DI_{15}^{30}$ value of the coke becomes higher with a longer average residence time, the $DI_{15}^{30}$ value being higher than 90.5 with an average residence time longer than 17 minutes.

[III] Primary reduced-pressure distillation

As mentioned hereinbefore, the heavy oils which have been separated from the light oils by the gas-liquid separator 7 are subjected to reduced-pressure distillation in the first distillation tower 8. At this time, coking (polycondensation reaction) takes place at the bottom of the distillation tower 8, depending upon the conditions of the primary hydrogenation reaction. Therefore, it is necessary to study the relation between the residence time of reactants in the first hydrogenation reactor and the degree of coking.

In both B and D of the foregoing Example, the average residence time is about 34 minutes but the amount of reactants having a residence time shorter than 10 minutes is almost zero, showing a different residence time distribution from D in which the proportion of such reactants is about 30%.

For the purpose of comparison, the heavy oils obtained in Runs B and D of different residence time distribution were subjected to reduced-pressure distillation under the conditions shown in Table 4, with or without deashing. The physical and chemical properties of the solvent-refined coals obtained at the bottom of the tower are also shown in Table 4.

TABLE 4

Physical and chemical properties of deashed and non-deashed SRC (solvent-refined coal)

| | Conditions of reduced-pressure distillation | | Deashed SRC (PS) | | | Non-deashed SRC | | |
|---|---|---|---|---|---|---|---|---|
| Run | Temp. | Press. | BI content | H/C | R&B (°C.) | BI content | H/C | R&B (°C.) |
| B | 330° C. | 40 mmHg | 40.0 | 0.893 | — | 40.0 | 0.889 | 190 |
| | 301° C. | 90 mmHg | 27.0 | 0.925 | 150 | 34.5 | 0.923 | 160 |
| D | 330° C. | 40 mmHg | 50.2 | 0.879 | — | 50.2 | 0.862 | 192 |
| | 301° C. | 90 mmHg | 36.4 | 0.876 | 155 | 50.6 | 0.860 | 162 |

Table 5 below shows the physical and chemical properties of Table 4 in a comparative form.

TABLE 5

| Conditions of distillation | Deashed SRC | | | Non-deashed SRC | | |
|---|---|---|---|---|---|---|
| | BI content | H/C | R&B | BI content | H/C | R&B |
| 330° C., 40 mmHg | D>B | B>D | — | D>B | B>D | D>B |
| 301° C., 90 mmHg | D>B | B>D | D>B | D>B | B>D | D>B |

As is clear from the foregoing table, always

D>B in BI (benzene insoluble content),

B>D in H/C (hydrogen/carbon: degree of polycondensation), and

D>B in R & B (ring & ball softening point).

In this instance, it is to be noted that:

(1) BI is a polymer, and a high value in BI reflects a large content of organic polymers of high condensation degree, which lends itself to increase the viscosity lowering the deashing efficiency and increasing the loss of organic components along with mineral ash components, as well as a large content of unstable substances which cause coke deposition on the catalyst for the secondary hydrogenation reaction;

(2) A high value in H/C reflects a high polycondensation degree and causes the adverse effects as in (1) above; and (3) The softening point R & B is closely related with the degree of polycondensation and the molecular weight, and a high value in R & B results in the adverse effects as in (1) and (2).

Thus, in contrast to B with a sharp residence time distribution, D with a wider distribution has the following tendencies.

(i) The deashing operation becomes difficult due to the high viscosity of SRC with a high degree of polycondensation;

(ii) The efficiency of separation of mineral ash components from the organic components in the deashing step is lowered, increasing the loss of organic components; and (iii) The content of unstable substances which cause deterioration of hydrogenation catalyst in the secondary hydrogenation reaction subsequent to the deashing step is increased.

Therefore, where a liquid product is intended, the deashing operation is facilitated by maintaining a sharp residence time distribution, effectively lessening the deterioration of the secondary hydrogenation catalyst thereby to increase the yield of the end product.

As is clear from the foregoing description, in reforming coal by the hydrogenation process, it becomes possible to produce solvent-refined coal of a quality suitable for use as a metallurgical carbonaceous material or as an intermediate material for a liquid product by controlling the residence time distribution of reactants in the primary hydrogenation reaction zone. A solvent-refined coal which is particularly suited for the production of metallurgical coke can be obtained by controlling the residence time of the reactants, excepting gaseous reactants, in the primary hydrogenation reaction zone to have an average residence time longer than 17 minutes, and to keep the quantity of the reactants which have a residence time shorter than 10 minutes in a proportion less than 20% by weight of the reactants.

The solvent-refined coal thus obtained can be blended into the raw material in the production of coke to obtain a product having a good strength suitable for producing steel. In addition, the solvent-refined coal which can also serve as an intermediate material for a liquid product has a desirable quality, so that is can contribute to lower the viscosity in the deashing step and to decrease the deterioration of the catalyst in the secondary hydrogenation. Therefore, the present invention can be suitably applied to also obtain satisfactory results in a process which produces a liquid product through further deashing and secondary hydrogenation steps.

What is claimed is:

1. In a process for reforming coal by subjecting a mixed slurry containing a hydrocarbon solvent and coal fines to hydrogenation reaction under high temperature and pressure conditions, gas-liquid separation, and distillation to obtain a solvent-refined coal, the improvement comprising:

maintaining the reaction temperature and total reaction pressure within a hydrogenation reactor at 400° to 500° C. and 50 to 200 atms., and controlling the residence time distribution of reactants, excepting gaseous reactants, in the hydrogenation reaction zone to have an average residence time longer than 17 minutes, and to keep the quantity of said reactants which have a residence time shorter than 10 minutes in a proportion less than 20% by weight of said reactants.

2. The improvement of claim 1, wherein the product mixture resulting from said hydrogenation reaction is for use in a metallurgical carbonaceous material.

3. The improvement of claim 1, wherein the product mixture resulting from said hydrogenation reaction is further subjected to deashing and secondary hydrogenation reaction to produce a liquid product.

* * * * *